United States Patent [19]

Schmidt

[11] 4,412,865

[45] Nov. 1, 1983

[54] DEVICE FOR SEPARATING A FILLER MASS

[75] Inventor: Heinrich Schmidt, Düsseldorf, Fed. Rep. of Germany

[73] Assignee: Hein, Lehmann AG, Düsseldorf, Fed. Rep. of Germany

[21] Appl. No.: 216,214

[22] Filed: Dec. 12, 1980

[30] Foreign Application Priority Data

Dec. 21, 1979 [DE] Fed. Rep. of Germany ..... 2951666

[51] Int. Cl.[3] ..... C13F 1/06; H05B 6/78

[52] U.S. Cl. ..... 127/19; 127/63; 219/10.51 A; 219/10.55 M; 210/787; 494/13

[58] Field of Search ..... 219/10.55 R, 10.55 A, 219/10.55 M, 10.55 F, 10.55 E, 10.51, 10.65; 127/19, 56, 58, 63; 210/787; 233/11

[56] References Cited

U.S. PATENT DOCUMENTS

| | | | |
|---|---|---|---|
| 2,086,951 | 7/1937 | Stevens | 127/19 X |
| 2,585,970 | 2/1952 | Shaw | 219/10.55 A X |
| 3,171,009 | 2/1965 | Scheller et al. | 219/10.55 R |
| 3,495,648 | 2/1970 | Amadon | 219/10.55 A |
| 3,668,358 | 6/1972 | Stenstrom | 219/10.55 R |
| 4,008,098 | 2/1977 | Dietzel et al. | 127/19 |
| 4,052,304 | 10/1977 | Vertenstein | 127/19 |
| 4,205,999 | 6/1980 | Zeichner | 127/19 |

FOREIGN PATENT DOCUMENTS

| | | |
|---|---|---|
| 971234 | 9/1964 | United Kingdom . |
| 1074229 | 7/1967 | United Kingdom . |
| 1122987 | 8/1968 | United Kingdom . |
| 1222208 | 2/1971 | United Kingdom . |
| 1260975 | 1/1972 | United Kingdom . |
| 1371400 | 10/1974 | United Kingdom . |

*Primary Examiner*—B. A. Reynolds
*Assistant Examiner*—Philip H. Leung
*Attorney, Agent, or Firm*—Allison C. Collard; Thomas M. Galgano

[57] ABSTRACT

A device for separating a filler mass into solid and liquid components and, in particular, for converting a highly viscous sugar filler mass into sugar crystals and molasses, includes a centrifuge, a dosaging device for feeding the filler mass and a device for heating the filler mass immediately before centrifuging. The invention is characterized by the fact that the device for heating the filler mass is a high frequency heating device.

11 Claims, 2 Drawing Figures

DEVICE FOR SEPARATING A FILLER MASS

Figure 1:
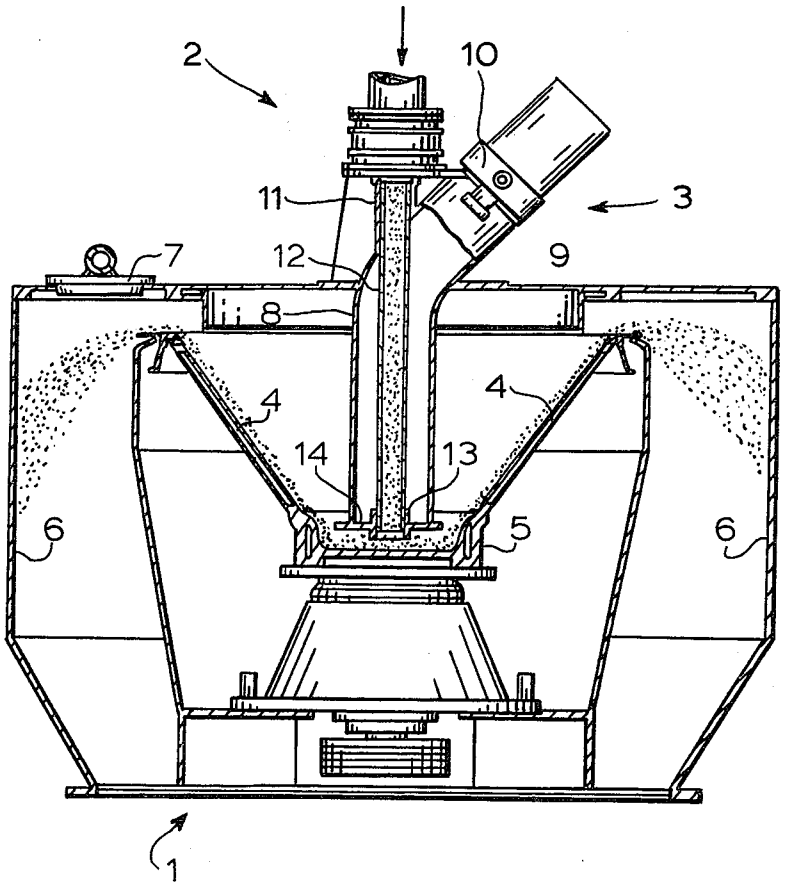

The invention relates to a device for separating a filler mass or filler into a solid and a liquid component. More particularly, it relates to such a device for converting a highly viscous sugar filler mass into sugar crystals and molasses of the type which includes a centrifuge, a dosaging device for feeding the filler mass and a device for heating the filler mass immediately before centrifuging.

Devices of these types are generally known. They are used in the sugar industry for continuously centrifuging sugar filler or filler mass and, in particular, medium- and low-grade massecuites. The sugar filler mass is a mixture of sugar crystals and molasses. This mixture is cooled as much as possible before centrifuging, so that the sugar is crystallized as much as possible. However, the lowering of the temperature for the mixture increases the viscosity considerably. The higher the viscosity, the more difficult it becomes to separate the mixture into solid material and liquid components. Therefore, the temperature is limited towards its lower range. Consequently, in order to obtain a good sugar yield, the mixture is initially cooled to a lower temperature and, subsequently, the filler mass is rapidly heated immediately before centrifuging.

In a known device, the temperature increase for the filler mass is effected by admitting steam, generally saturated steam or a hot steam, to the filler mass while the filler mass flows into the centrifuge. However, it was shown that even if the steam is blown by jet nozzles directly onto the surface of the filler mass stream or strand, hardly any heat reaches the inside thereof.

Only during distribution and acceleration of the filler mass strand is the remaining steam and the hot condensation water able to heat the filler mass totally. However, in the meantime, a local overheating occurs in the surface range of the filler material, which results in a bursting of the sugar crystals due to heat shock, so that the sugar again is dissolved.

It is therefore an object of this invention to provide a device of the aforementioned type which permits an even heating of the filler mass throughout its cross section immediately before centrifuging while allowing, at the same time, the filler mass to be fed continuously and without interference into the centrifuge.

This object of the invention is obtained in a device of the aforementioned type wherein the device for heating the filler mass is a high frequency heating device. High frequency heating devices are frequently called "microwave heating devices" or, in short "microwave heaters". Due to the effect of the microwaves in the operating range of the centrifuge, the filler mass strand which is fed from the dosaging device is evenly heated throughout its total cross section.

The filler mass absorbs energy as a dielectric in the electrical microwave field and is thereby rapidly heated. The temperature increase in the interior of the filler mass is even a little bit higher than at the surface. Furthermore, it was shown that in an advantageous manner, only the liquid is primarily heated and not the solid material. Therefore, only a low amount of sugar is dissolved despite the heat.

For shaping the microwave field, it is favorable that the high frequency heating device is provided with a substantially straight pipe portion or piece serving as a wave conductor into which a filler feed pipe or socket discharges coaxially for the filler mass. The pipe piece is essentially circular in its cross section.

The filler mass may be particularly easily heated without any interference and continuously when the pipe portion is angled at its upper end. A device for coupling the microwaves is provided on the angled extension of the pipe portion. Thereby, the pipe portion is tuned to the microwave frequency or may be tuned to the microwave frequency.

In order to prevent stray microwaves from escaping from the device in the range of the dosaging device, the filler socket or feed pipe couples the pipe portion, in the area of its bend, with the dosaging device in a straight line and without any interruptions. The filler socket and the pipe portion may be made of metal and are tightly sealed and coupled on all sides.

A simple feeding of the filler mass into the pipe portion is assured when a coaxially arranged funnel-like jet tube is provided in the filler socket which projects only somewhat into the pipe portion. A discharge edge which is disposed at a right angle with respect to the axis of the jet tube prevents the filler mass from being deflected when it enters the pipe portion. The filler mass flows from the jet tube in a free fall centrally into the acceleration device.

A secure feeding of the filler mass within the pipe portion is made possible by means of a filler mass pipe which is coaxially mounted in the filler socket and which extends to the lower end of the pipe portion and is maintained in a longitudinally moveable manner in a guide bushing. The guide bushing is coupled with the pipe portion in a sealing manner by means of an annular plate. Thereby, a sufficiently high pressure has to be applied to the filler mass, so that the same can flow in a sufficient amount through the installed filler mass pipe.

Stray microwaves can be easily and securely prevented from reaching the basket of the centrifuge when the pipe portion extends into the distribution and acceleration device for the filler mass which is provided in the lower range of the centrifugal basket of the centrifuge. The distribution and acceleration device is preferably provided with a labyrinth seal by means of overlapping upper and lower acceleration rings.

A particularly safe and efficient device is obtained in accordance with the invention in that the pipe portion, the filler socket, the annular plate and/or the distribution and acceleration device are made of microwave-reflecting material, for example, steel, alloyed or highly alloyed steel. The filler pipe and the jet tube are preferably made of heat-resistant glass which affords a low microwave loss, i.e., it has a low damping effect on the microwaves.

Other objects and features of the present invention will become apparent from the following detailed description when taken in connection with the accompanying drawings which disclose several embodiments of the invention. It is to be understood that the drawings are designed for the purpose of illustration only and are not intended as a definition of the limits of the invention.

Figure 2:
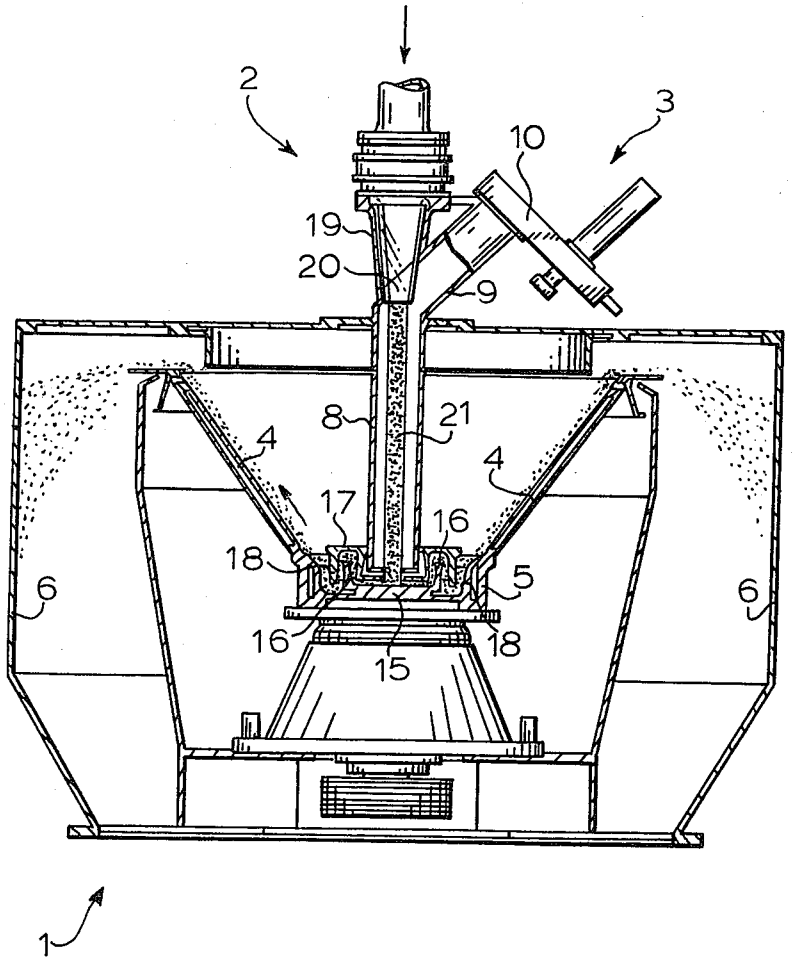

In the drawings, wherein similar reference characters denote similar elements throughout the several views:

FIG. 1 is a cross-sectional view, in part elevation, of a device embodying the present invention; and FIG. 2 is a cross-sectional view, in part elevation, of a further embodiment of the invention.

Referring now in detail to the drawings, FIG. 1 shows an inventive device with a continuously operating centrifuge 1, a dosaging device 2 and a microwave heater 3. The centrifuge 1 is provided with a cone-shaped, upwardly-expanding centrifugal basket 4 which is directed to an upper discharge end and which has a vertical rotational axis. A non-perforated acceleration container 5 is coupled to the smaller diameter end of the centrifuge basket 4. The centrifuge basket 4 is practically enclosed on all sides by a metallic centrifuge housing 6. All openings in the housing can be tightly sealed to prevent the escape of the microwaves. As far as the openings are concerned for maintenance, observation and/or sample taking, which are closed with removable lids, it is advantageous to couple the same directly with the microwave heater. In this way, it is possible to automatically shut off the microwave heater when a lid, for example, lid 7, is opened.

Dosaging device 2 is provided above centrifuge 1. The dosaging device which usually is a filler mass slide may be axially aligned with the axis of the centrifuge 1. However, an eccentric mounting is feasible.

Microwave heater 3 with its associated units is essentially disposed between dosaging device 2 and the bottom of the accelerator container 5. The microwave heater is provided with a pipe portion or piece 8 which is bent at an angle of about 45° at its upper end. Pipe piece 8 serves as a microwave conductor. It is tuned or may be tuned to the microwave frequency.

A device 10 for coupling the microwaves is mounted on the extension 9 of pipe piece 8. Device 10 is provided with a magnetron, preferably a constant current magnetron, as a generator and microwave energy source. The efficiency or output of a constant current magnetron may be several kilowatts (kw) with a degree of efficiency of up to 50%. Electrons in the magnetron emit a part of their energy. With the aid of this energy, resonant circuits are excited. The microwave energy may then be fed to the filler mass through the pipe piece 8 which acts as the output line. The coupling of the pipe piece to the generator may be carried out by means of a coaxial cable, either inductively by means of a coupling loop or capacitively by means of an adjustable coupling pin at the location of the largest electric field strength.

A short feed pipe or filler socket 11 leads from pipe piece 8 in the range of its bend, in a straight line and without any interruptions, to dosaging device 2. A filler mass pipe 12 is coaxially mounted with respect to pipe piece 8. It extends to the lower end of pipe piece 8 and is maintained therein in a longitudinally moveable manner by means of a guide bushing 13. An annular plate 14 connects the guide bushing in a sealing manner with the pipe piece 8. In order that the microwave field can operate in the filler mass pipe 12 without any loss and so that it may, with a high degree of effectiveness, affect the filler mass, the filler mass pipe consists of a heat-resistant glass having a low microwave damping value. The parts which encompass the inventive device, in particular, pipe piece 8, filler mass feed pipe 11, guide bushing 13 and annular plate 14, as well as centrifuge basket 4, acceleration container 5 and centrifuge housing 6, consist of a microwave-reflecting material. This microwave-reflecting material may be made from suitable metal-like steel, alloyed steel or highly alloyed steel, for example. Electrical safety switches assure an automatic disconnection of the generator for the microwave generation when any of the lids are opened.

The particularly high viscous filler mass consisting of sugar crystals and molasses flows from dosaging device 2 into the operating range of microwave heater 3 with its associated units. The filler mass is fed in filler mass pipe 12 within this operating range. The microwaves are introduced with the aid of device 10 into pipe piece 8 which serves as the microwave conductor and the microwave energy is fed to the filler mass. While the filler mass flows through the filler mass pipe, it is exposed to the microwaves. It has been shown that only the liquid components of the filler mass—namely, the molasses absorbs the microwaves and is thereby heated, while the solid components-namely, the sugar crystals do not absorb any microwaves or hardly absorb any microwaves so that they are not directly heated.

The sugar crystals can only absorb heat secondarily from the encompassing molasses. However, the effect time is so short that the sugar crystals are dissolved in a very low quantity. The intensity of the microwave energy and thereby the degree of heating can be easily controlled. With suitable transmitters, it is possible to control the flow of energy proportionally to the supplied filler mass. The control device may cause an immediate shutdown of the generator which generates the microwaves, if the flow of filler mass is interrupted. This is very important in view of the high energy density in the microwave field. The microwave generator generates microwaves preferably within a frequency range of 2,200 MHz to 2,600 MHz, and preferably 2,400 MHz to 2,500 MHz. When the heated filler mass stream or strand leaves the filler mass pipe, it enters into the accelerator container 5 and is accelerated therein in a known manner, evenly distributed and fed to the lower edge of the centrifuge basket. The filler mass may be additionally supplied with water and/or steam in the centrifuge basket and/or in the accelerator container. The separation into sugar crystals and molasses occurs on the path from the lower edge of the centrifuge basket to the upper discharge edge thereof.

FIG. 2 shows a sectional view of a further inventive device with a continuously operating centrifuge 1, a dosaging device 2 and a microwave heater 3. Again, the centrifuge is provided with a conically-expanding centrifuge basket 4 directed to the upper discharge end with a vertical rotational axis. A non-perforated acceleration container 5 is coupled to the smaller diameter end of the centrifuge basket.

A rib-like acceleration ring 16 extends upwardly from the bottom 15 of the acceleration container coaxially with respect to the basket axis. Bottom 15 is covered with a cover ring plate 17 spaced at a distance therefrom, from which depend two rib-like upper acceleration rings directed downwardly in a coaxial manner with respect to the lower ring. The rings 16 and 18 are disposed in a type of labyrinth seal. The free deflection edge of the lower ring 16 is positioned above the deflection edge of upper ring 18. Otherwise, the centrifuge 1 corresponds to the centrifuge shown in FIG. 1. This is also true for the dosaging device 2. The microwave heater 3 with its associated units is essentially disposed between dosaging device 2 and the bottom of the acceleration container 5. Again, the microwave heater 3 is provided with a pipe piece 8 which is deflected by about 45° at its upper end. The pipe piece 8 is tuned or may be tuned to the microwave frequency. The same device 10 for feeding the microwaves as mentioned with respect to the aforementioned example is mounted on the deflected extension 9 of the pipe piece 8. A downwardly-tapering reduced filler socket or feed pipe 19 leads from the pipe piece 8 at the range of its deflection in a straight and uninterrupted fashion to the dosaging device. A funnel-shaped jet tube or pipe 20 is coaxially disposed in filler socket 19. The mounting may be carried out by means of a recess which is provided at the upper flange of the filler socket into which a shoulder or protrusions of the jet pipe engage. The jet pipe is provided with a perpendicular smooth lower edge with respect to its longitudinal axis which extends somewhat but completely into pipe piece 8. The jet pipe may consist of heat resistant, low loss glass. With its lower end, pipe piece 8 projects into the acceleration container 5.

The particular high viscous mass is fed through the dosaging device 2 into the operating range of the microwave heater 3 with its associated units. After leaving the jet pipe 20, the filler mass flows freely and unsupported in the form of a strand 21 in a concentrical manner through pipe piece 8 wherein the molasses component is heated and the mixture is fed into the acceleration container. In this embodiment, only a fraction of the microwaves can reach the centrifuge chamber, due to the arrangement and shape of the acceleration rings of the acceleration container. The centrifuge chamber is closed metallically on all sides, so that the outer surroundings of the centrifuge remains free of stray microwave radiation.

Thus, while only several embodiments of the present invention have been shown and described, it will be obvious that many changes and modifications may be made thereunto, without departing from the spirit and scope of the invention.

What is claimed is:

1. In a device for separating a sugar-containing filler mass into a solid and a liquid component of the type including a continuously operating centrifuge, a dosaging device for feeding the filler mass to the centrifuge, and a device for heating the filler mass immediately before being fed to the centrifuge, the improvement comprising:

said device for heating said filler mass comprising a microwave heater including a substantially straight pipe piece serving as a wave conductor, and a filler feed pipe which is coaxially coupled to said pipe piece for discharging the filler into said pipe piece.

2. The device according to claim 1, wherein said pipe piece has an angled extension joined to its upper end, and wherein said heating device further comprising a microwave coupler for coupling the microwaves to said filler mass, said microwave coupler being provided on said angled extension of said pipe portion.

3. The device according to claim 2, wherein said filler feed pipe couples said pipe piece, in the area of its joinder to said angled extension, to said dosaging device in a straight and uninterrupted manner.

4. The device according to claim 1, 2, or 3, wherein a funnel-shaped jet tube is disposed in said feed pipe which projects only slightly into said pipe portion.

5. The device according to claim 1, 2 or 3, wherein a filler mass pipe is coaxially mounted within said pipe piece and extends to the lower end of said pipe piece and is maintained therein in a longitudinally moveable manner by means of a guide bushing, said guide bushing being coupled to said pipe piece in a sealing manner by means of an annular plate.

6. The device according to claim 1, 2 or 3, wherein said centrifuge includes a centrifuge basket and a distribution and acceleration device for the filler mass disposed at the lower end of said centrifuge basket, wherein said pipe piece projects into said distribution and acceleration device and wherein said distribution and acceleration device includes overlapping upper and lower acceleration rings which define a labyrinth seal.

7. The device according to claim 6, wherein said pipe piece, said feed pipe, and said distribution and acceleration device are made of microwave-reflecting material.

8. The device according to claim 4, wherein said jet tube is made of a heat-resistant glass which has a low microwave loss.

9. The device according to claim 5, wherein said filler mass pipe is made of a heat-resistant glass which has a low microwave loss.

10. The device according to claim 5, wherein said annular plate is made of microwave-reflecting material.

11. A process for continuously centrifuging massecuite to produce sugar crystals comprising the steps of:

allowing the massecuite to fall freely;

rapidly heating the massecuite during the free fall by means of a microwave heater to improve the flowability thereof, said heater having a substantially straight pipe piece serving as a wave conductor and a filler feed pipe coaxially coupled to said pipe piece for discharging the massecuite into said pipe piece; and immediately thereafter, terminating the free fall and continuously introducing said heated massecuite into said centrifuge to produce sugar crystals.

* * * * *